US005289235A

United States Patent [19]

Sakanobe et al.

[11] Patent Number: 5,289,235

[45] Date of Patent: Feb. 22, 1994

[54] IMAGE PRODUCING APPARATUS

[75] Inventors: Makoto Sakanobe, Kanagawa; Yoshikazu Tamura, Ebina, both of Japan

[73] Assignee: Fuji Xerox Co., Ltd., Tokyo, Japan

[21] Appl. No.: 775,205

[22] Filed: Oct. 11, 1991

[30] Foreign Application Priority Data

Dec. 27, 1990 [JP] Japan ..... 2-415142
Jan. 17, 1991 [JP] Japan ..... 3-015736

[51] Int. Cl.[5] ..... G03G 15/048; G03G 15/32

[52] U.S. Cl. ..... 355/239; 355/212; 355/229

[58] Field of Search ..... 355/239, 244, 220, 229, 355/219, 212, 211

[56] References Cited

U.S. PATENT DOCUMENTS 3,580,671 5/1971 Lavander ..... 355/239 X
4,007,981 2/1977 Goren ..... 355/239
4,366,220 12/1982 Saito ..... 355/229 X
4,572,647 2/1986 Bean et al. ..... 355/239

FOREIGN PATENT DOCUMENTS 62-103663 5/1987 Japan .
62-127868 6/1987 Japan ..... 355/244
64-61773 3/1989 Japan .

*Primary Examiner*—A. T. Grimley
*Assistant Examiner*—Shuk Y. Lee
*Attorney, Agent, or Firm*—Finnegan, Henderson, Farabow, Garrett & Dunner

[57] ABSTRACT

A screen lamp can be mounted easily. A belt type photoreceptor 15 is rotatably provided along a plurality of rollers 14 and 14-1, and a screen lamp 28 is mounted on there are side of the belt type photoreceptor 15 with respect to the rollers 14-1. The rollers 14-1 maintain a predetermined clearance between the belt type photoreceptor 15 and the screen lamp 28. And a pattern exposing device which ensures small size, simple construction and low cost is disclosed.

13 Claims, 16 Drawing Sheets

PARALLEL

TRAPEZOID

WEDGE

IMAGE PRODUCING APPARATUS

BACKGROUND OF THE INVENTION

The present invention relates to an image producing apparatus used primarily for an electro-photographic copying machine, printer, and facsimile.

A well known conventional image producing apparatus has image producing devices such as a primary corotron, image exposure, developer, transfer corotron, and cleaner around an image carrier. The surface of the image carrier is uniformly charged by the primary corotron and then an image is exposed to i.e. the surface to form an electrostatic latent image thereon. The electrostatic latent image is then developed by the developer into a visual image which in turn is transferred by the transfer charged corotron onto a sheet of paper. The paper is then fed to a fixer to be fixed. Then, residual is cleaned off the image carrier by a cleaner.

Such conventional image producing apparatus do not provide good reproducibility of an original having continuous gradation such as photographs, and therefore a construction as shown in FIG. 22 is used to improve reproducibility.

A screen lamp 6 formed of a screen 4 and a light source 5 is disposed between an image exposure 2 and a developer 3 behind a belt type photoreceptor 1. An original image is exposed by the image exposure 2 onto the surface of the belt type photoreceptor 1 uniformly charged by the corotron 7 to form a latent image thereon. Then, a screen-like optical image is projected by the screen lamp 6 onto the rear surface of the belt type photoreceptor 1 to form a screen-like non-charged portion so as to form an electrostatic latent image into fine stripes. Then, the electrostatic latent image is developed by the developer 3 into a visual image so as to reproduce an image of the original with continuous gradation.

With the above-described apparatus, the cavity latitude between the screen 4 of screen lamp 6 and the belt type photoreceptor 1 is important so that the screen lamp 6 must be accurately positioned relative to the belt type photoreceptor 1. The mounting of the screen lamp 6 is not only time-consuming but also difficult when replacing the screen lamp 6.

With an image producing apparatus (referred to as copying machine hereinafter) using the prior art electrophotography method, a uniformly charged image carrier(referred to as photoreceptor or photosensitive material hereinafter) is exposed to a light that carries the image of an original, so that a latent image is formed on the photographic body. The latent image is developed with a toner to produce a toner image which in turn is transferred onto an image-transferred material (referred to as paper hereinafter). The toner image is then fixed to provide a hard copy. The formation of a latent image, development of the image, and transfer of the developed image are carried out on the same sheet of paper for each color component to provide a full color copy.

Such an electrographic copying machine will not reproduce the same gradation (degree of brightness) as the original image, when producing a picture-like image such as photographs. Thus, it is difficult to produce an image having the same quality as the original. In which case, the photographic body is uniformly charged, and then a pattern image consisting of a net or a plurality of lines are formed for improved gradation of a copy.

Japanese Patent Preliminary Publication No. 62-103663 discloses a prior art pattern exposing apparatus that produces a pattern formed of a plurality of lines. This pattern exposing apparatus has a pattern plate in the vicinity of the photoreceptor, the pattern plate being made of a transparent material such as glass whose surface is printed through photomechanical process with a pattern having light-transmitting parts arranged alternately with non-light-transmitting parts. An incandescent lamp such as a tungsten bulb is provided at a position relatively remote form the pattern plate. In the light path between the incandescent lamp and the pattern plate is provided a shutter for intercepting the light. The thickness of the pattern printed on the pattern plate is on the order of several microns, In order that the pattern-carrying lights transmitted through the pattern plate are uniform in the direction transverse to the movement direction of the photographic body, the incandescent lamp should be remote from the pattern plate so that the lamp can be regarded as a point source. Since incandesdent lamps cannot be quickly turned on or off, the maps are lighted at all times and a shutter is placed in the light path to intercept the light so as to expose a pattern light only when the pattern light is required. This pattern exposing apparatus is referred to as a second prior art apparatus hereinafter.

Japanese Patent Preliminary Publication No. 64-61773 discloses an apparatus in which a pattern latent image is made with a net. This pattern exposing apparatus is provided with an image-forming lens which is mounted near a photoreceptor and extend transversely of the photoreceptor. The pattern exposing apparatus also has a pattern filter spaced apart from the image-forming lens, in which pattern filter a net pattern is formed in correspondence with a pattern to be formed. The apparatus further has light emitting diodes as a point source spaced apart from the pattern filter and means for controlling the on-and-off operation of the light emitting diodes. The light from the light source is converted into a pattern-carrying light by the pattern filter and is directed by the image forming lens to the surface of the photoreceptor. The control means controls the light to intermittently be emitted so as to form a net-like pattern latent image.

The provision of an image forming lens in the aforementioned manner permits the production of a substantially uniform pattern latent image even if the distance between the pattern filter and the light source is relatively short. This is referred to as a third prior art apparatus and is smaller in size than the aforementioned second prior art apparatus.

With the second prior art apparatus, the incandescent bulb should be positioned such that the incandescent bulb can be regarded as a point source. This leads to larger sizes of apparatus. A bulb must be capable of emitting a large amount of light so as to expose a sufficient amount of light onto the surface of photoreceptor because the incandescent bulb is remotely located. This requires a large amount of electric power. The light path must be selectively blocked by the use of, for example, a shutter. This leads to complex construction.

The above-described third prior art apparatus is further miniaturized than the second prior art apparatus. However, the apparatus includes a very expensive image-forming lens, being disadvantageous. Further, the apparatus is of a complex construction in which the on-and-off operation of the light source is controlled in synchronism with the movement of the photoreceptor.

SUMMARY OF THE INVENTION

An object of the present invention is to provide an image producing apparatus having a lamp-mounting construction that solves the drawbacks of the aforementioned first prior art apparatus. This object is achieved by an image producing apparatus having a lamp-mounting construction in which a lamp 28 is mounted midway between the charging area and developing area on the rear side of the belt type photoreceptor 15 with respect to a roller 14 and 14-1 that guides the belt type photoreceptor.

The belt-like photo-sensitive body 15 rotates along the rollers 14 and 14-1. The screen lamp 28 is mounted with respect to the rollers 14-1. Thus, the screen lamp can easily be mounted in such a away that a predetermined distance is maintained between the lamp 28 and the belt type photoreceptor 15.

A photorecepter supporting frame 13 includes a front vertical plate 10 and a rear vertical plate 11 which are connected together by at least one tie-plate 12 or/and tie-bar (in FIG. 5, a single tie-plate 12 is shown) that extends transversely of the movement of photoreceptor. The belt type photoreceptor 15 is rotatably mounted on the photo-sensitive body 15 supporting frame 13 along a plurality of rollers. Disposed around the belt type photoreceptor 15 are a charger 18, image exposure 19, developer 20, and transferring device 21 which form an image producing apparatus as a whole. A pair of rollers 14-1 and 14-1 are disposed closely to each other between the charging area and the developing area of the photoreceptor supporting frame 13. Then, the screen lamp 28 is positioned with respect to the pair of rollers 14-1.

The belt type photoreceptor 15 is exposed to the screen lamp 28 in a narrow area between the pair of rollers 14-1 and 14-1. Thus, it is possible to accurately maintain a relationship between the belt type photoreceptor 15 and the screen lamp 28 in the respective positions, so that the belt type photoreceptor 15 can be disposed within the depth W2 of the bright-dark patterns formed by the screen lamp 28.

An object of the invention is to make up for the aforementioned prior art drawbacks and provides an image producing apparatus having a small, inexpensive pattern exposing device.

In order to achieve the aforementioned subject, the invention provides an image producing apparatus having an original-image exposing device and a pattern exposing apparatus. In the original-image exposing device, the surface of uniformly charged movable photosensitive material is exposed to a light so as to produce an electrostatic latent image corresponding to the original image. In the pattern exposing apparatus, a photosensitive material is exposed to a light so as to produce an electrostatic latent image in the form of slits spaced apart by a predetermined distance. Then, the electrostatic latent image formed on the photosensitive material is developed with a toner and the toner image is transferred onto a transfer material. The pattern exposing device is constructed as follows:

A plurality of infinitesimal light sources are aligned at equal pitches substantially transversely of the movement direction of the photosensitive material. A plate opaque to light is formed with a plurality of slits therein, thereby providing near the photorecepter between the photorecepter and light sources a pattern plate having light transmitting areas placed alternatively with opaque area. Then, the infinitesimal light sources are aligned with pitches therebetween so as to produce between the pattern plate and the photorecepter a plurality of bright-dark patterns having a bright area positioned alternately with a dark area along the row of the infinitesimal light sources. This pattern exposing device is disposed such that the photorecepter lies on one of the plurality of bright-dark patterns.

The plurality of infinitesimal light sources are housed in a chassis that has an opening and is optically shielded except for the opening. The pattern plate is fixed to close the opening, and the inner wall of chassis is of a less reflecting color.

The light sources are housed in the chassis optically shielded except for the portion where the pattern plate is mounted with the infinitesimal light sources S positioned relative to the pattern plate P, so that the light from the pattern exposing device is prevented from affecting the other devices disposed within the image producing apparatus and the bright-dark pattern is prevented from being disturbed by lights from other devices. The reason why the inner wall of chassis is of a less reflecting color such as black, is that the reflection by the inner wall of chassis is prevented from disturbing the bright-dark pattern.

A larger depth of dark areas can be obtained by forming the slits in an opaque material of a required thickness than by printing light opaque areas on, for example, a transparent glass. The former process is preferably used to form a pattern plate.

The pattern exposing device is positioned relative to the photorecepter such that one of the bright-dark patterns lies On the surface of the photorecepter. Pitches of dark areas in the X direction, depth W2, and the accuracy of the photorecepter determine which bright-dark pattern is to be used.

The depth W2 of dark areas can be made larger by employing the construction where a partition is provided between each and the next infinitesimal light so as to restrain the orientation of emission of light of respective light sources. The large depth W2 of dark areas allows larger manufacturing errors of, for example, the photorecepter and positional errors between the photorecepter and the pattern exposing device.

According to the invention, a plurality of infinitesimal light sources are aligned with a predetermined distance therebetween and a pattern plate is made by forming slits in an opaque material having a required thickness so as to produce a plurality of bright-dark patterns on the side opposite to the light sources with respect to the pattern plate. With a relatively short space between the infinitesimal light sources and the pattern plate, the slit-like latent image can be produced on the photorecepter. This is advantageous to ensure smaller sizes of the device. Light sources may be of infinitesimal light sources such as LEDs which emit a small amount of light as compared to incandescent, lamps. This requires only a small power, amount of being economical. Unlike the prior art construction, the construction of the invention requires no complex shutter and expensive image-forming lenses, being advantageous to ensure simple construction, small size, and low cost.

Partitions are added to the aforementioned construction between each and the next infinitesimal light source so as to section the space in the chassis transversely of the row of light sources. The height of the partitions extending toward the pattern plate is adjusted so as to restrain the orientation of emission of respective light sources.

FIG. 6 is an illustrative diagram illustrating how the bright-dark patterns are formed by the pattern exposing device according to the present invention. FIG. 1 is only exemplary and has the following construction.

The infinitesimal light sources are formed of LEDs 4 mm spaced apart.

The infinitesimal light sources S and the pattern plate P are spaced 30 mm apart. The thickness p1 of pattern plate P is 0.1 mm, the width(opening width) p2 of the light transmitting areas is 0.1 mm, and the width(closed width) p3 of light opaque areas is 0.1 mm(so-called 5 lp/mm). In the following description, the direction in which the infinitesimal light sources S are aligned is referred to as X direction, the direction from the infinitesimal light sources to the pattern plate p is referred to as Y direction, and the direction normal to the paper is referred to as Z direction.

As shown in FIG. 6, the bright-dark patterns are formed on the side opposite to the infinitesimal light sources with respect to the, pattern plate, so that a light opaque area(the inside of the oval area, referred to as dark area hereinafter) is formed alternately with a light transmissive area(around the oval area, referred to as bright area) and aligned in the X direction so as to produce a bright-dark pattern as a whole. A plurality of bright-dark patterns are produced in the direction(Y direction) away from the pattern plate, each being separated in order. Only two patterns are shown in the figure. With increasing distance form the pattern plate, the patterns have larger pitches in the X direction and the dimension W2(referred to as focal depth hereinafter) in the Y direction becomes greater.

While the above example has been described as having infinitesimal light sources 4 mm spaced apart, the invention is not limited to this space. However, as the pitch W1 of the infinitesimal light sources S becomes closer to zero, the dark areas become smaller and eventually disappear. On the other hand, a larger pitch W1 does not provide a sufficient amount of light for exposing the surface of the photorecepter. Thus, it is necessary to select a suitable pitch taking into account the distance W3 between the infinitesimal light sources S and the pattern plate P, the thickness p1 of the pattern plate P, and the width p2 of slits formed in the pattern plate P.

DETAILED DESCRIPTION OF PREFERRED EMBODIMENTS

Figure 1:
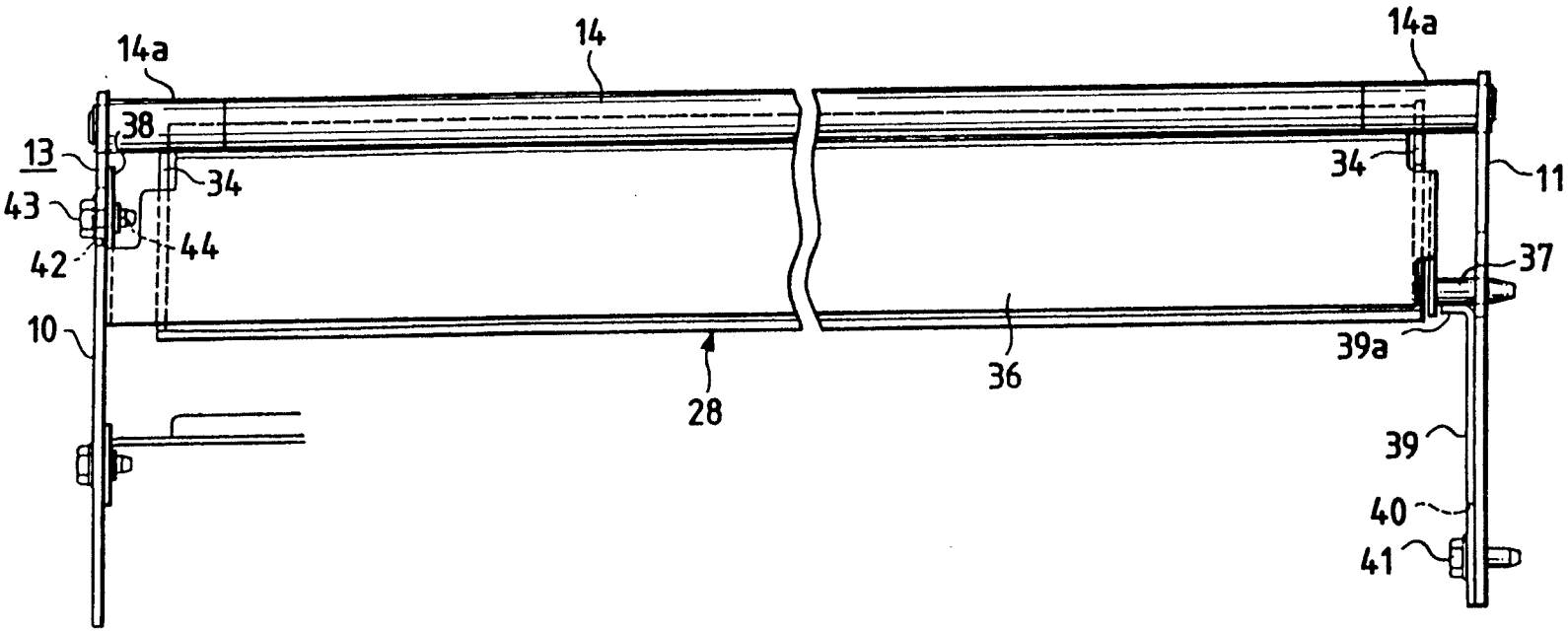
FIG. 1 is a front elevation view of a screen-lamp mounting section of a first embodiment of an image producing apparatus according to the present invention.
Figure 2:
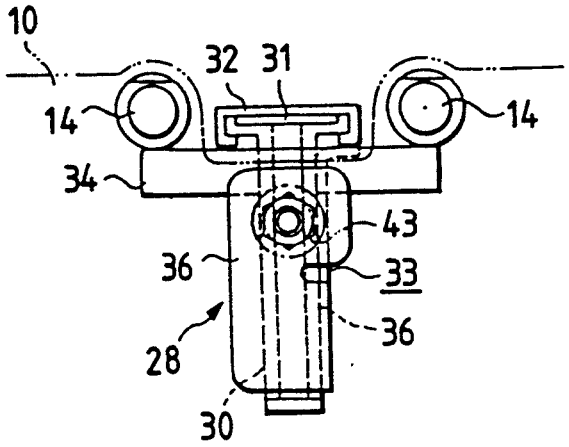
FIG. 2 is a left side view of the first embodiment.
Figure 3:
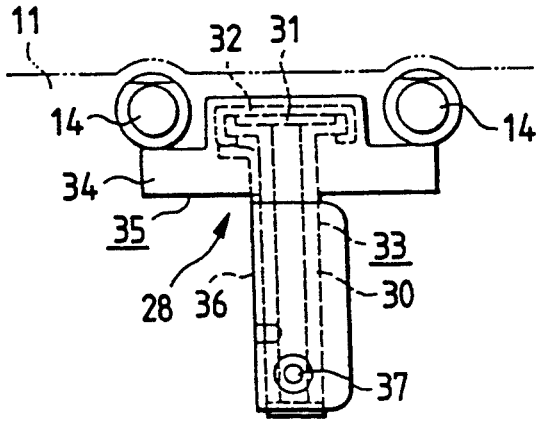
FIG. 3 is a right side view of the first embodiment.
Figure 4:
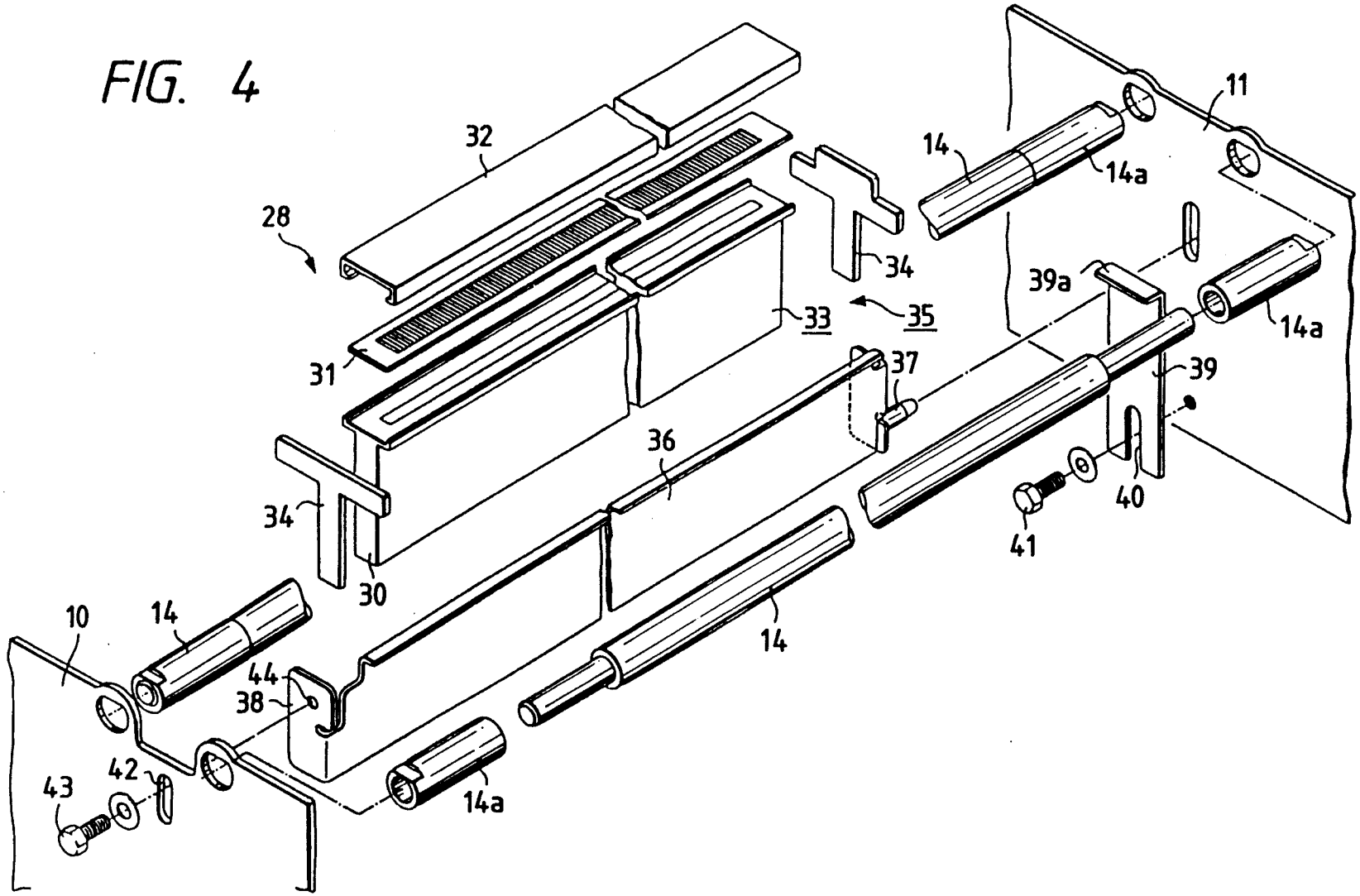
FIG. 4 is an exploded view of the first embodiment.
Figure 5:
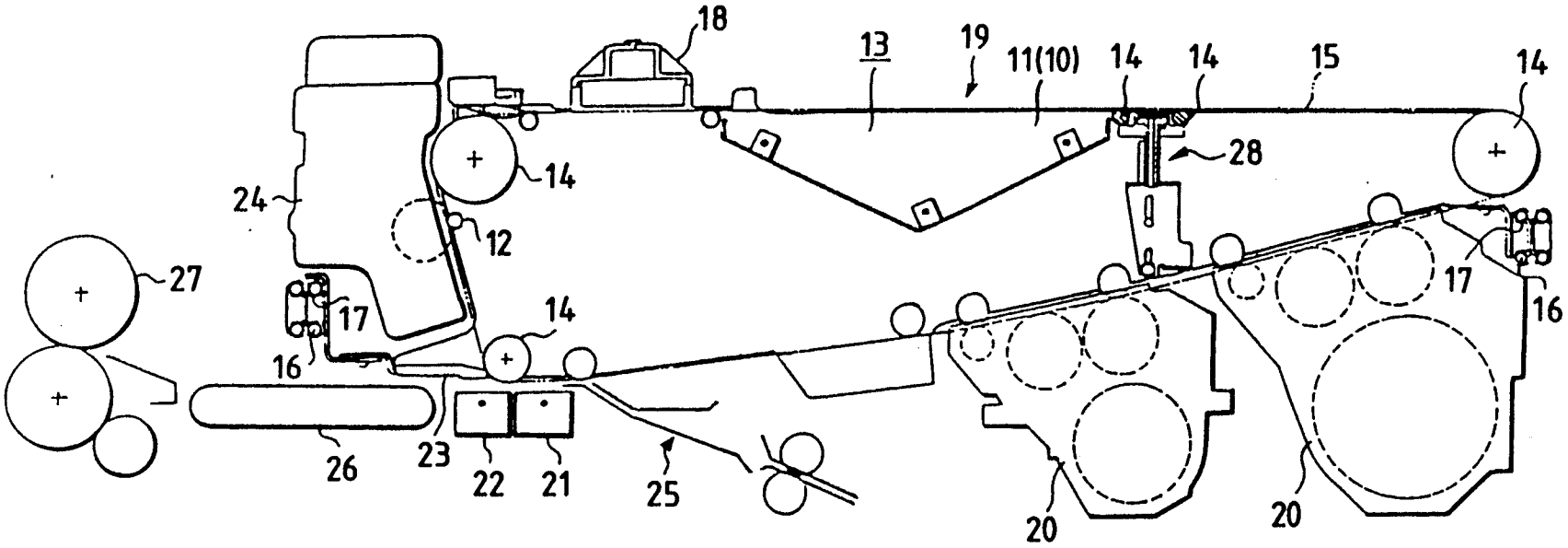
FIG. 5 is a front view of an image producing apparatus.

Referring to FIG. 5, a photorecepter supporting frame 13 is constructed of a front vertical plate 10 and a rear vertical 11, connected together by at least one tie-plate and/or tie-bar 123. A belt type photoreceptor 15 is arrayed on a plurality of rollers 14 mounted on the photorecepter 15 supporting frame 13. A part of the plurality of rollers, which have a small angle brought into contact with the belt type photoreceptor 15, may be of a non-rotatable type. The frame 13 has guide rails 16 and 16 mounted on the left and right sides which slide on rails 17 mounted on the main chassis of the apparatus, so that the frame 13 can be easily inserted into and drawn out of the apparatus.

The apparatus has a charger 18, image exposing section 19, developer 20, transfer section 21, separator 22, separating hook 23, and cleaner 24, which are aligned to oppose the photorecepter 15. The image of an original is exposed onto the surface of photorecepter 15 uniformly charged by the charger 18 so as to form an electrostatic latent image. The electrostatic latent image is then developed by the developer 20 into a visible image, which in turn is transferred by a transfer section 21 to a sheet of paper supplied through a paper feeding path 25. The paper is then separated by separator 22 and separating hook 23 before being sent via a transport 26 to the fixation section 27 where the paper is fixed.

A screen lamp 28 is disposed between the image exposing section 19 in the photorecepter supporting frame 13 and the developer 20 and opposes the rear surface of the belt type photoreceptor 15.

As shown in FIGS. 1-4, the screen lamp 28 has a lamp main o body 33 where a screen 31 is provided on a lamp housing 30 having a lamp therein and a cover 32 is mounted on the lamp housing 30. Substantially T-shaped side plates 34 and 34 are attached to the two longitudinal ends of the lamp main body 33, thus forming a main body 35 made of synthetic resin. To the sides of lamp housing 30 of the main body 35 are mounted mounting plates 36 made of metal by means of thermal staking. The mounting plate 36 has a supporting pin 37 mounted at one longitudinal end of the plate 36, and a mounting strap 38 at the other end of the mounting plate 36. Further, left and right side plates 34 and 34 are positioned relative to the pair of rollers 14-1 and 14-1 that span across the front and rear vertical plates 10 and 11.

A bolt 41 is threaded into the rear vertical plate 11 through a vertical cutout 40 in the supporting plate 39 so as to mount the supporting plate 39 against the inner surface of the rear vertical plate 11. The supporting plate 39 has an upper bent portion 39*a* carrying a supporting pin 37 thereon. The screen amp 28 is temporarily supported by a bolt 43 threaded into a threaded hole 44 in the mounting strap 38 through a vertically elongated hole 42. Then, the supporting plate 39 is moved upwards and the bolt 41 is tightened such that one of the side plates 34 is pressed against a bearing bush 14-la, by means of which the pair of rollers 14-1 are rotatably supported by the rear vertical plate 11. Then, the other longitudinal end of screen lamp 28 is moved upwards and the bolt 43 is tightened such that another side plate 34 is pressed against the underside of a bearing bush 14-la, by means of which the pair of rollers 14-1 are rotatably supported by the front vertical plate 11. In this manner, the screen lamp 28 is mounted relative to the pair of rollers 14-1 and 14-1. In this embodiment the roller 14-1 is the same as the roller 14-1*a* in a diameter. However, it may be possible to delete the use of the roller 14-1*a* and to directly contact the outer periphery of the roller 14-1 with the T-shaped side plate 34. The supporting plate 39 may be biased upwards by, for example, a spring. In addition, the cover 32 functions so as to prevent dust (such as a toner) from collecting in an inner chamber of the lamp housing 30 or the screen (pattern plate) 31, so that it is possible to delete the use of the cover 32. Further, the T-shaped side plate 34 may be integrally formed with the lamp main body 33.

Thus, belt type photoreceptor 15 moves while contacting the upper surface of the pair of rollers 14-1 and 14-1. The screen lamp 28 is pressed against the underside of the rotating bushes 14-1*a* and 14-1*a* that support the pair of rollers 14 and 14. This not only ensures a constant gap(cavity) between the screen lamp 28 and the belt type photoreceptor 15 at all times but also facilitates assembly work thereof.

The belt type photoreceptor 15 rotates while contacting the upper surface of the pair of rollers 14-1 and 14-1 which are mounted with a small pitch therebetween. Thus, the belt type o photoreceptor will not vibrate when it passes the screen lamp 28, so that the surface of belt type photoreceptor 15 exposed to the screen lamp 28 has good flatness. This prevents the belt type photoreceptor 15 from being beyond the focal depth of the screen lamp 28, or this prevents the electrostatic latent image of the bright-dark pattern from being formed on the photorecepter 15.

While the above embodiment has been described with respect to the screen lamp 28 provided between the image exposing section 19 and the developer 20, the screen lamp 28 may be provided between the charger 18 and the developer 20. Another possible way is that the pair of rollers 14-1 are unrotatably mounted and the side plates 34 are pressed against the underside of the rollers.

The belt type photoreceptor 15 rotates along the rollers 14 and 14-1, and the screen lamp 28 is mounted relative to the rollers 14-1. The screen lamp 28 may easily be mounted such that there is a predetermined clearance between the belt type photoreceptor 15 and the screen lamp 28. The belt type photoreceptor 15 is exposed to the light from the screen lamp 28, so that the belt type photoreceptor 15 will not vibrate, when it is in the exposing area and so that the distance between the screen lamp 28 and the belt type photoreceptor 15 will not be beyond the focal depth of the screen lamp 28 or the electrostatic latent image of the bright-dark pattern is surely formed on the photoreceptor 15.

The other embodiment of the invention will now be described in detail with reference to the drawings prior to the description of the embodiment, the general construction of a copying machine to which the present invention is applied is described in two types; one is a drum type photorecepter and the other is a belt type photorecepter. Then, the specific construction of a pattern exposing device to which the present invention is applied, will be described in detail.

(1) The general construction of a copying machine using a drum type photorecepter.

Figure 7:
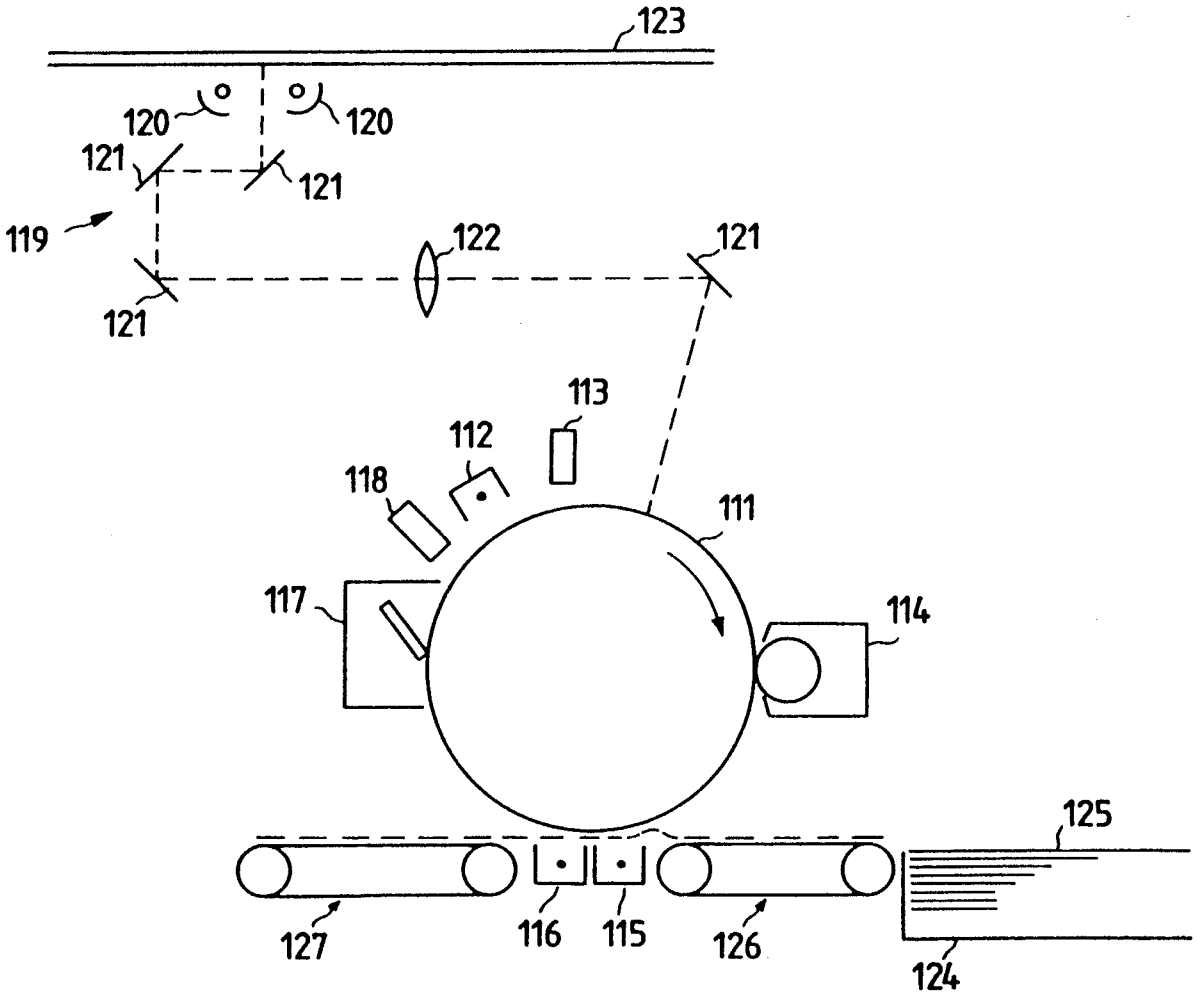
FIG. 7 shows a general construction of a copying machine using a drum type photosensitive body.

Referring to FIG. 7, reference numeral 111 is a rotating photosensitive drum. Disposed in order on the periphery of the photosensitive drum 111 are a charger 112, a pattern exposing device 113 according to the present invention, a developer 114, a transfer corotron 115, a separator corotron 116, a cleaner 117, and discharger 118 Between the pattern exposing device 113 and the developer 114 is defined a position where an original is exposed. Reference numeral 119 denotes a scanning/exposing device(original-exposing device) constructed of a lamp 120 for illumination, a plurality of mirrors 121, and a lens 122. The lamp 120 illuminates an original placed on the platen glass 123 and the light is directed by the plurality of mirrors 121 and a lens 122 to the exposing position. Reference numeral 124 denotes a paper cassette for storing a plurality of sheets of paper 125 therein. The paper 125 is taken out one by one from the paper cassette 124 and is delivered by paper carrying devices 126 and 127 which are endless belts arrayed about a pair of rollers.

The photosensitive drum 111 is uniformly charged by the charger 112 and a slit-like electrostatic latent image is then produced thereon by the pattern exposing device 113. Then, an electrostatic latent image corresponding to an original image is superposed onto the slit-like electrostatic latent image. The electrostatic latent image is developed with toner by the developer 114 to subsequently be delivered close to the transfer corotron 115. At this time, the paper 125 is supplied by the paper carrying device 126 in synchronism with the rotation of the photosensitive drum 111, so that due to corona discharge, the paper 125 is electrostatically attracted to the surface of the photosensitive drum 111 carrying the tone image thereon and the toner image is transferred to the paper 125. Due to the corona discharge of the separator corotron 116, the paper onto which the toner image is transferred loses the attraction to the photosensitive drum 111 so that the paper is separated from the photosensitive drum 111 to subsequently be delivered by the paper carrying device 127. This, paper, not shown in the figure, has the toner fixed thereon by the fixing device and is then delivered into an external tray. The residual toner on the surface of the photosensitive drum 111 is removed by the cleaner 117, and the charges thereon are removed by the discharger 118 so as to prepare for the next copying operation.

Figure 8:
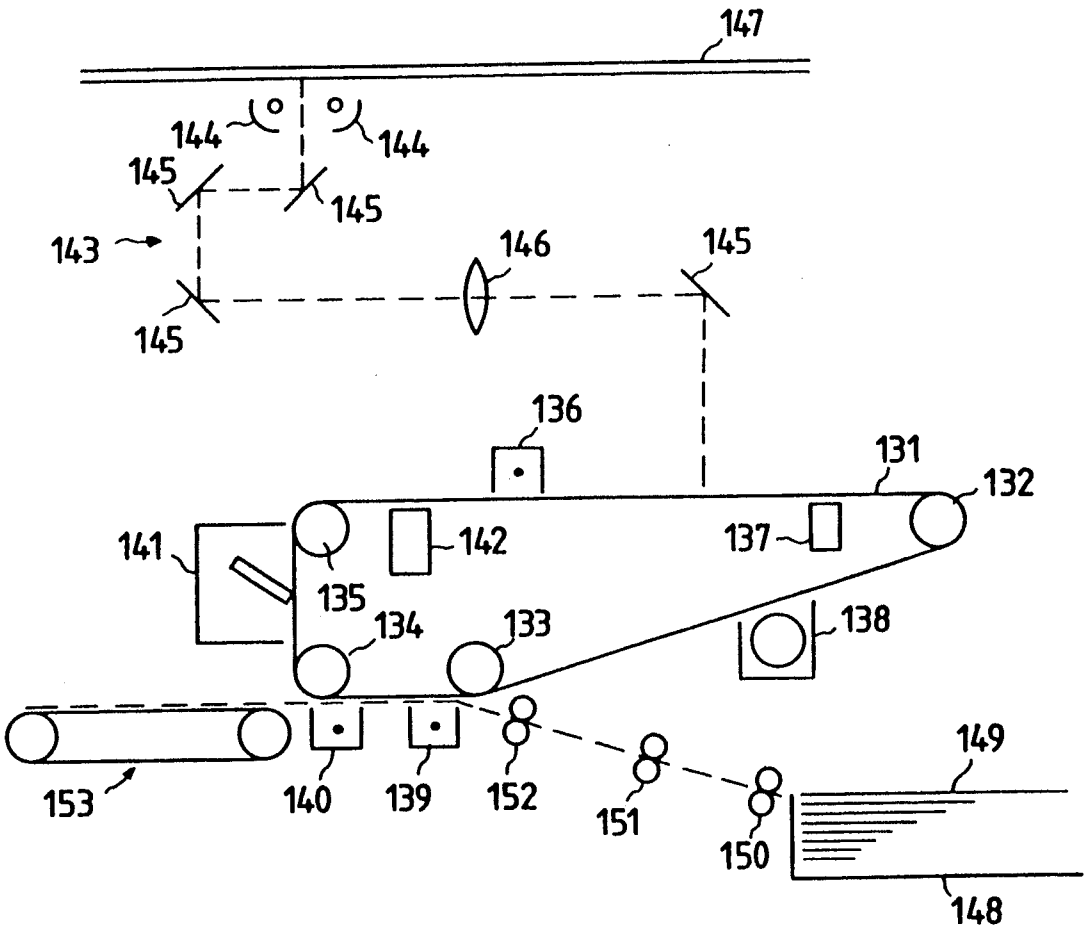
FIG. 8 shows a general construction of a copying machine using a belt type photorecepter.

(2) The general construction of a copying machine using a belt type photorecepter Referring to FIG. 8, reference numeral 131 denotes a belt type photoreceptor which is arrayed about four rollers 132, 133, 134, and 135. Disposed in order on the periphery of the photosensitive drum 131 are a charger 136, a pattern exposing device 137 according to the present invention, a developer 138, a transfer corotron 139, a separator/corotron 140, a cleaner 141, and a discharger 142. The pattern exposing device 137 and the discharger 142 and are disposed on the inside of the photosensitive belt 131 and the other devices are on the outside of the photosensitive belt 131. The original is exposed at a position between the charger 136 and the pattern exposing device 137. Reference numeral 143 denotes a scanning/exposing device(original-image exposing device) constructed of a lamp 144 for illumination, a plurality of mirrors 145, and a lens 146. The lamp 144 illuminates an original placed on the platen glass 147 and the reflected light is directed by the plurality of mirrors 145 and a lens 146 to the exposing position.

Reference numeral 148 denotes a paper cassette for storing a plurality of sheets of paper 149 therein. The paper 149 is taken out one by one from the paper cassette 148 and is delivered by a paper carrying devices 150, 151, and 152 which are pairs of rollers in pressing contact with each other, and a paper carrying device 153 having an endless belt arrayed about a pair of rollers.

Then, the surface of photosensitive belt 131 is uniformly charged by the charger 136 and electrostatic latent image corresponding to an original image is produced on the surface of the photosensitive belt by the scanning/exposing device 143. Then, a slit-like electrostatic latent image is produced in superposition to an electrostatic latent image corresponding to an original image. The electrostatic latent image is developed with toner by the developer 138 to subsequently be delivered close to the transfer corotron 139. At this time, the paper 149 is supplied by the paper carrying devices 150, 151, and 152 in synchronism with the rotation(displacement) of the photosensitive belt 131, so that due to corona charge, the paper 149 is electrostatically attracted to the surface of the photosensitive belt 131 carrying the toner image thereon and o the toner image is transferred to the paper 149. Due to the corona discharge of the separator corotron 140, the paper to which the toner image is transferred losses attraction to the photosensitive drum 131, so that the paper is separated from the photosensitive belt 131 to subsequently be delivered by the paper carrying device 153. This, paper, not shown in the figure, has the toner image thermally fixed thereon by the fixing device and is then delivered into an external tray. The residual toner on the surface of the photosensitive belt 131 is by removed the discharger 142 to prepare for the next copying operation.

(3) Specific Construction of a Pattern Exposing Device

Figure 9:
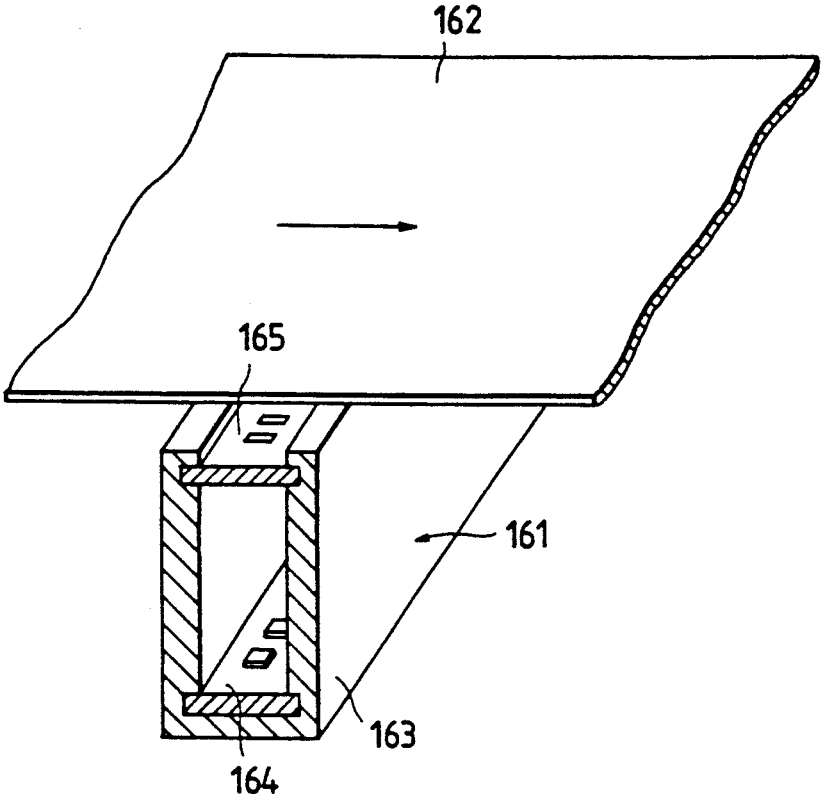
FIG. 9 is a cross-sectional view in part showing essential part of the embodiment of the invention.
Figure 10:
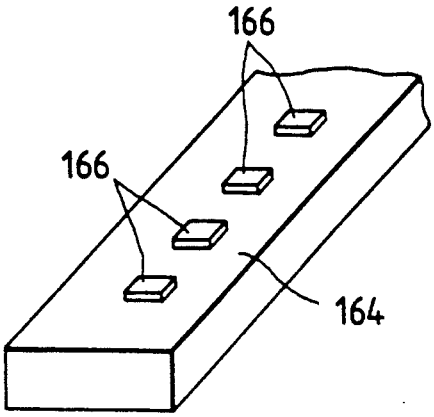
FIG. 10 is an expanded perspective view of a substrate on which the infinitesimal light sources of FIG. 9 are aligned.

Referring to FIG. 9, reference numeral 161 denotes a pattern exposing device according to the invention. Reference numeral 162 is a photorecepter (photo sensitive drum or photosensitive belt). Reference numeral 163 is a case of the pattern exposing device 161. The case 163 is made of ABS resin or formed A1. The case 163 is formed with a groove in its bottom into which the substrates 164 are inserted. As shown in FIG. 10, aligned on the surface of the substrates 164 are a plurality of LEDs 166 having a light emitting area of 275 $\mu m \times 175$ $\mu m$ formed through direct bonding. The LEDs 166 are 4 mm spaced apart in this embodiment.

Figure 11:
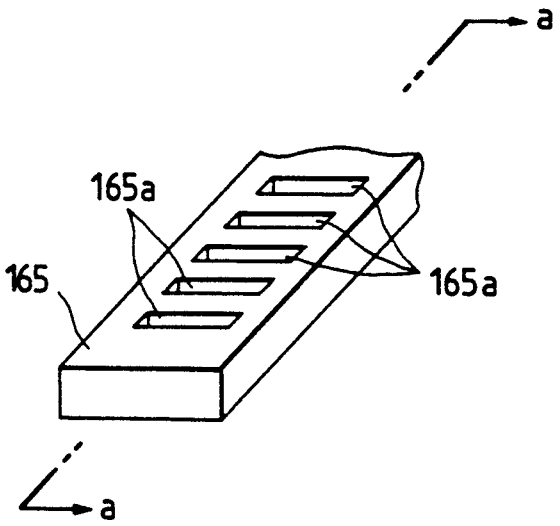
FIG. 11 is an expanded perspective view of a pattern plate of FIG. 9.
Figure 12:
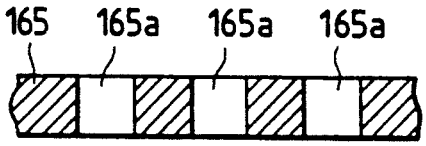
FIG. 12 is a cross-sectional view taken along the lines a—a of FIG. 11.

As shown in FIGS. 11 and 12, the pattern plate 165 is formed with a plurality of slits (grooves) 165*a* in a plate like member made of, for example, Stainless Steel. In this embodiment, the pattern plate 165 is 0.1 mm thick, and the slits 165*a* have a width(opening width) of 0.1 mm and distances(closed width) of 0.1 mm(so-called 5 lp/mm) therebetween. The plurality of LEDs 166 are 30 mm spaced apart from the pattern plate 165. The case 163 has side walls, not shown in FIG. 9, on its two longitudinal ends of the case 163. The case 163 is optically opaque except for portions where the pattern plate 165 is mounted. The inner wall of case 163 is black so as to ensure least optical reflection.

Figure 6:
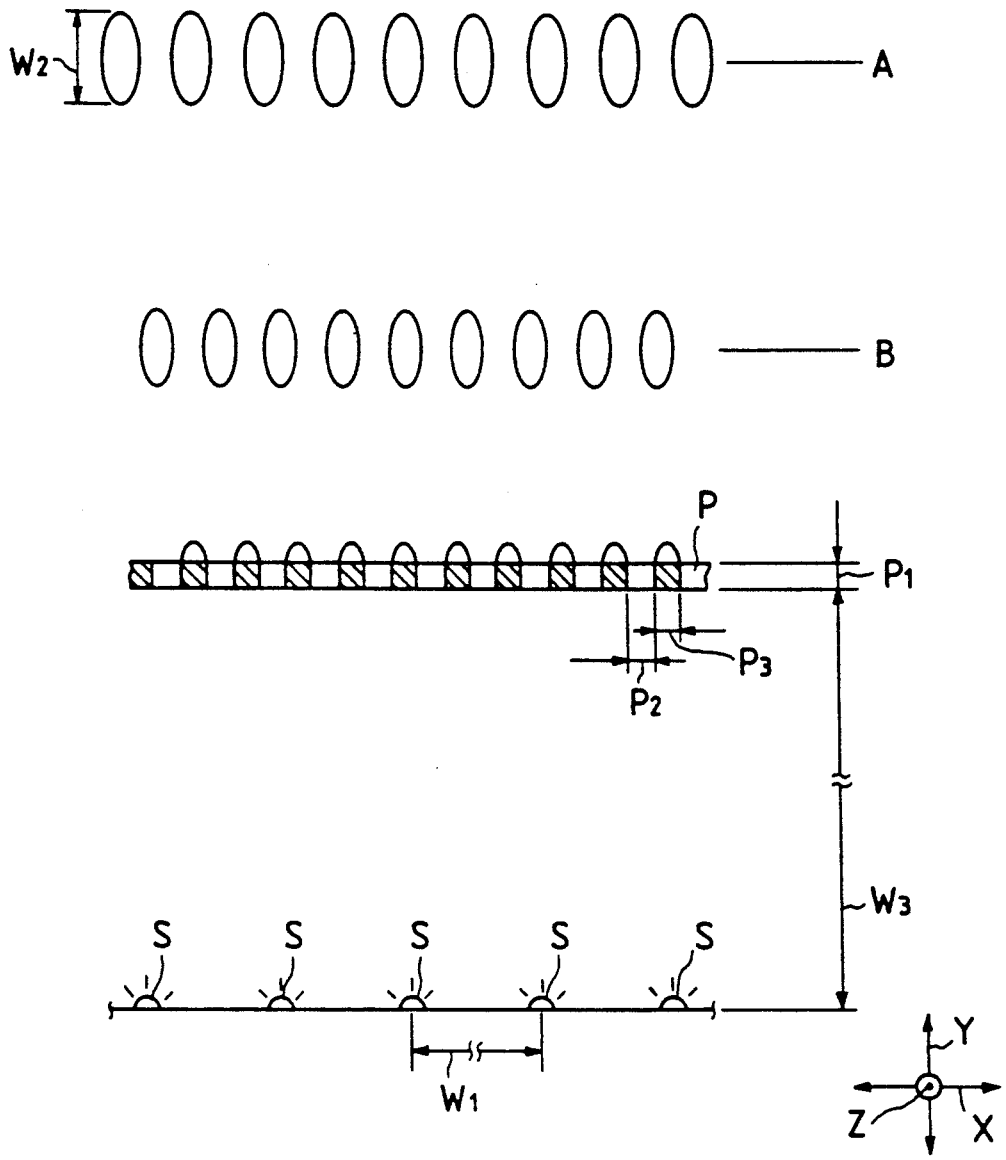
FIG. 6 is a diagram illustrating the operation of the invention.

The pattern exposing device 161 is positioned relative to the photorecepter 162. That is, the pattern exposing device 161 is positioned such that it extends transversely of the moving direction of the photorecepter 162 and one of the plurality of bright-dark patterns produced by the pattern exposing device 161 is positioned on the surface of the photorecepter 162. Specifically, the pattern exposing device 161 is positioned such that the surface of photorecepter lies at any one of A, B, . . . in FIG. 6.

Figure 13:
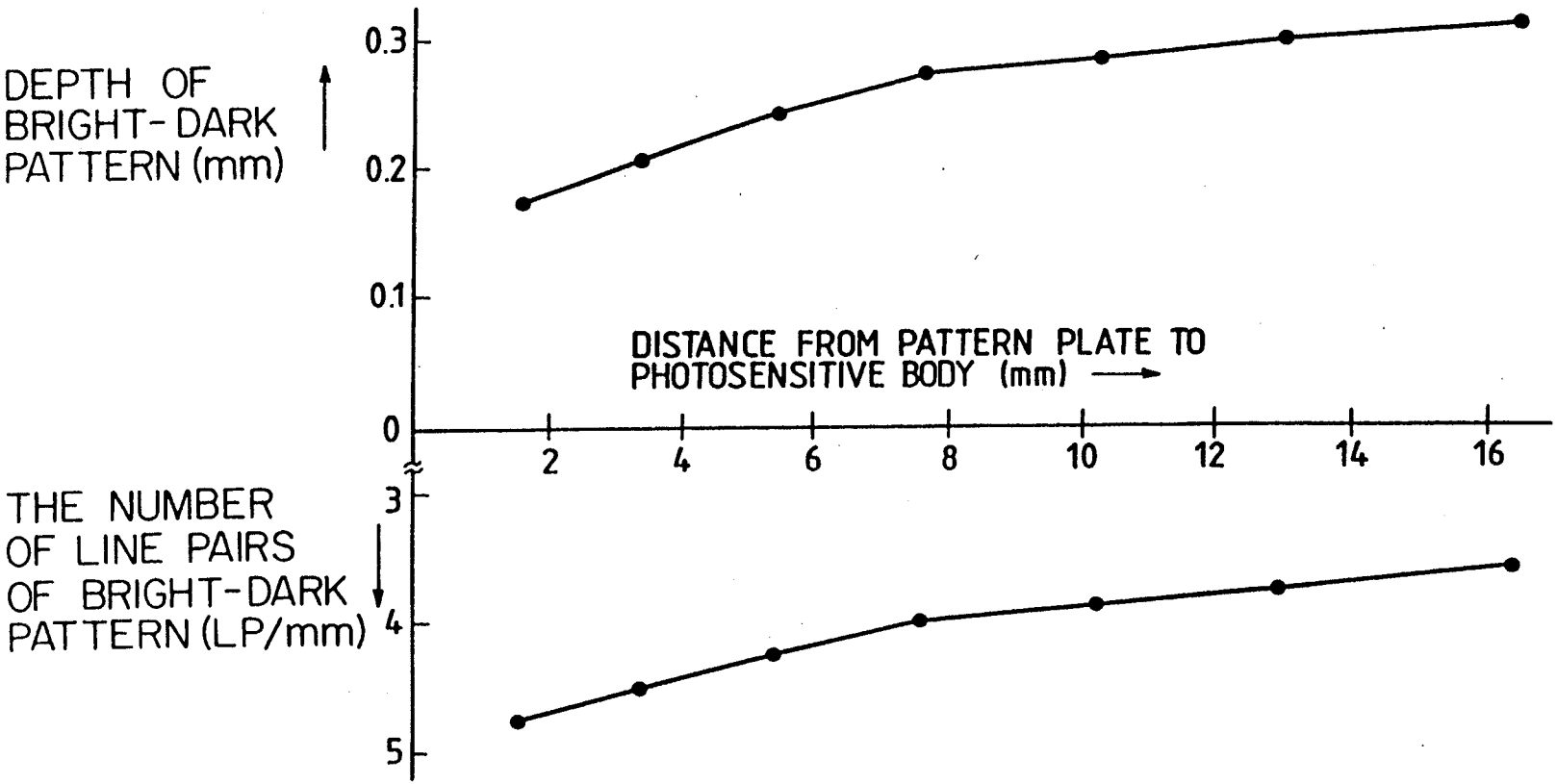
FIG. 13 is a graph showing a relationship between the distance of the pattern plate from the photorecepter and the focal depth of bright-dark pattern as well as a relationship between the distance of the pattern plate from the photorecepter and the number of line pairs of a bright-dark pattern.

FIG. 13 shows graphs of distances from the pattern plate 165 to the photorecepter 162 versus the focal depth of the bright-dark pattern, and the distance from the pattern plate 165 to the photorecepter 162 versus the number of pairs of lines (the number of pairs of dark areas and bright areas per 1 mm). As is apparent from FIG. 13, with increasing distance from the pattern plate 165 to the photorecepter 162, the focal depth of bright-dark pattern becomes larger and the number of paris of lines of the bright-dark pattern are smaller. For the pattern exposing device 161 and photorecepter 162, the larger the focal depth is, the greater the errors in manufacturing and in relative position are allowed. The amount of light exposed to the photorecepter 162 decreases with increasing distance from the pattern plate 165 to the photosensitive element. Without changing the construction of pattern exposing device, properly selecting the distance between the pattern plate 165 and the photorecepter 162 permits to change the number of pairs of lines of bright-dark pattern. Thus, most suitable distance should be selected from a standpoint of the required amount of light on the surface of the photorecepter 162, allowable error to the respective devices, and the pitch of the slit like electrostatic latent image to be produced.

Figure 14:
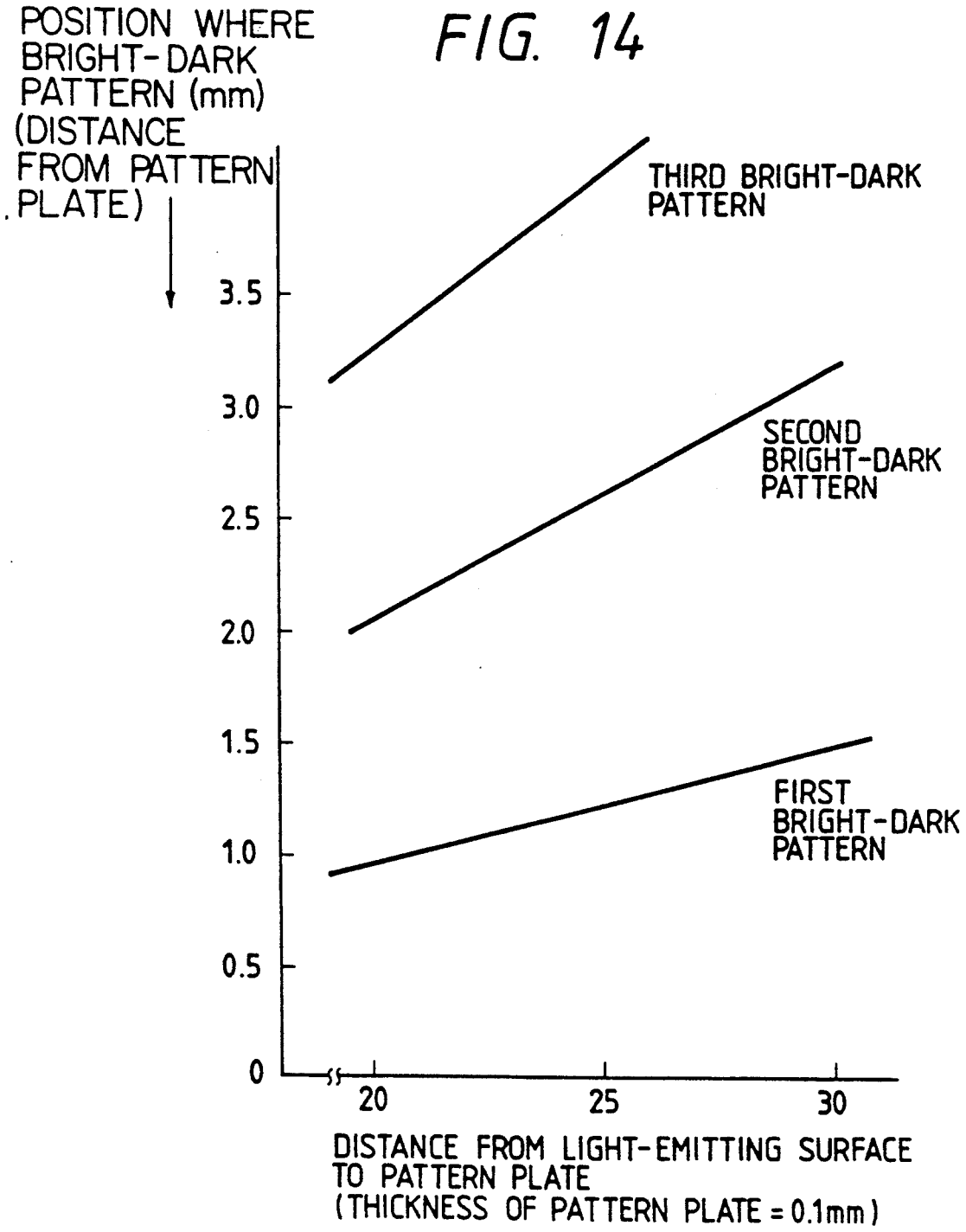
FIG. 14 is a graph showing a relation between the distance from the infinitesimal light sources to the pattern plate and a position where the bright-dark pattern is formed.
Figure 23:
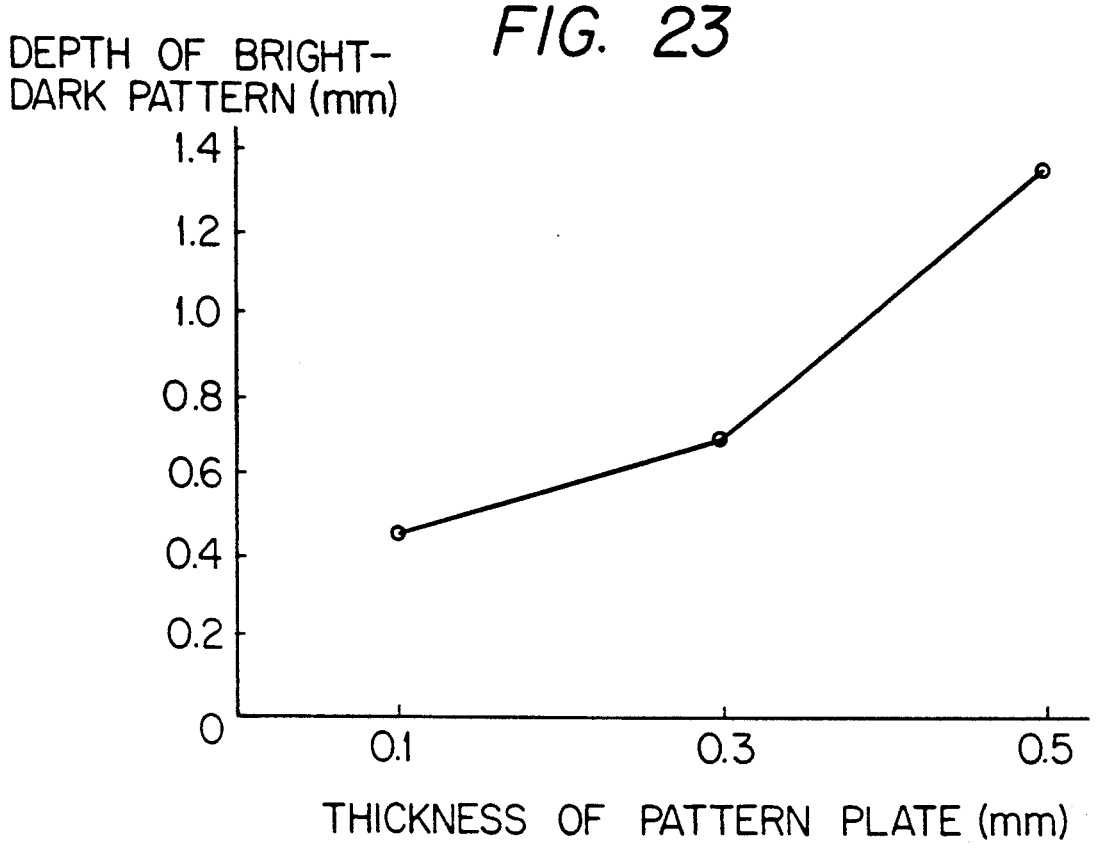
FIG. 23 is a diagram showing a relationship between a thickness of pattern plate and the focal depth of a bright-dark pattern.

FIG. 14 is a graph showing the position of the bright-dark pattern when the distance between the pattern plate 165 and the LEDs 166 is changed. As is apparent from FIG. 14, the smaller the distance between the pattern plate 165 and LEDs 166 is, the smaller the distance between the respective bright-dark pattern and the pattern plate 165. A smaller distance between the pattern plate 165 and LED 166 allows a greater amount of light to be exposed to the photorecepter, 162. Thus, making use of this nature enables the adjustment of the positional relation between the pattern exposing device 161 and the photorecepter 162 as well as the amount of light exposed to the photorecepter 162. If larger errors are to be allowed for the aforementioned respective devices, as shown in FIG. 23, the pattern plate may be made to have greater thickness since greater thickness of the pattern plate 165 permits greater focal depth of the bright-dark pattern.

Figure 24:
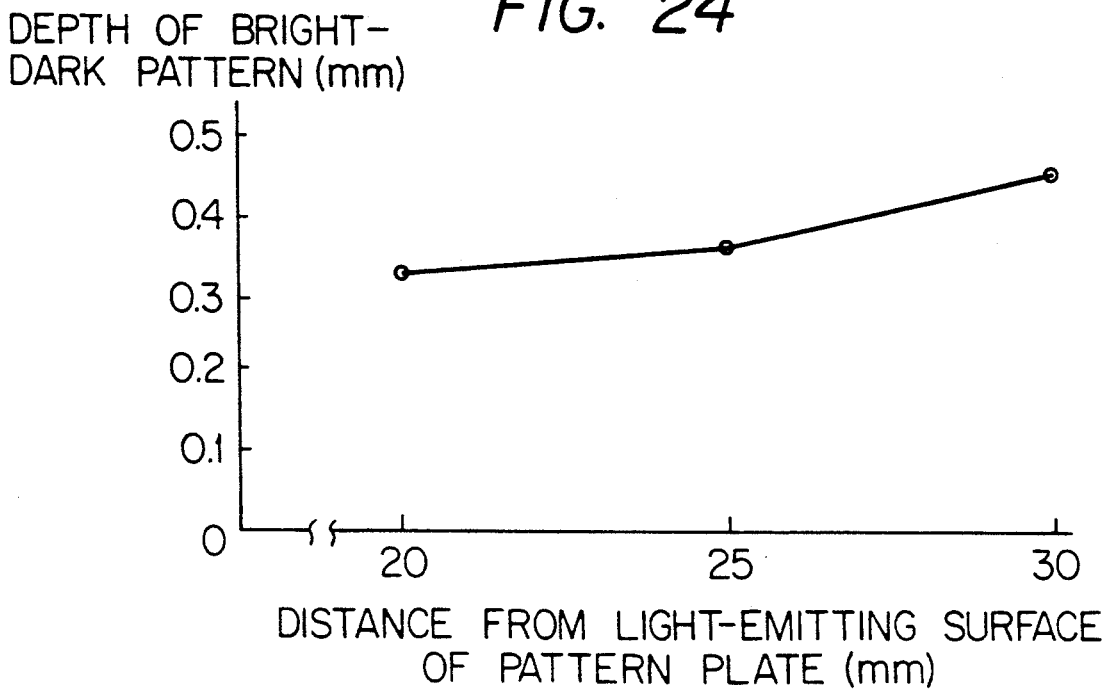
FIG. 24 is a diagram showing a relationship between a distance from light-emitting surface to pattern plate and a focal depth of a bright-dark pattern.

Further, as shown in FIG. 24, by increasing the distance from the light-emitting surface to the pattern plate, the focal depth of the bright-dark pattern is increased.

An experiment showed that a long neon lamp or fluorescent lamp used as a light source did not produce bright-dark patterns. Thus, the LEDs(infinitesimal light sources) 166 cannot be arranged with too short a pitch therebetween. On the other hand, with the increasing distance between the LEDs 166, the amount of light exposed to the photorecepter 162 is decreased, so that it is not preferable to make the distance so large. Thus, the distance between the LED 166 must be greater than a distance at which the bright-dark patterns are produced, but must be smaller than a distance at which the amount of light is not enough. A distance of 4 mm is preferred but is, of course, not limited to 4 mm.

Method of Manufacturing a Pattern

The pattern plate may be manufactured through, for example, lithography or etching. When manufacturing the pattern plate through lithography or etching, it is preferable to have slit width(aperture width) greater than the thickness the pattern plate for sufficient accuracy. For example, a slit width greater than 0.1 mm is preferred for a thickness of 0.1 mm. Thus, it is difficult to make a slit narrower than the thickness. In this case, the slits having a width greater than the thickness are first made and the thickness of the slits is then adjusted by means of plating or painting.

Figure 15A:
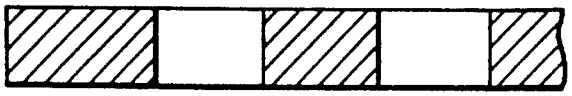
FIGS. 15(*a*), 15(*b*), and 15(*c*) are diagrams showing the cross section of slits when the pattern plate is made through etching process, (A) showing a rectangular cross section, (B) showing a trapezoidal cross section, and (C) showing a wedge-shaped cross section.
Figure 15B:
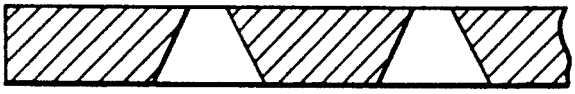
Figure 15C:
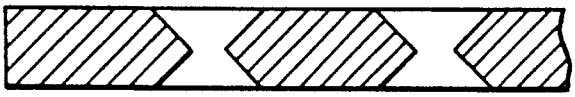
Figure 16:
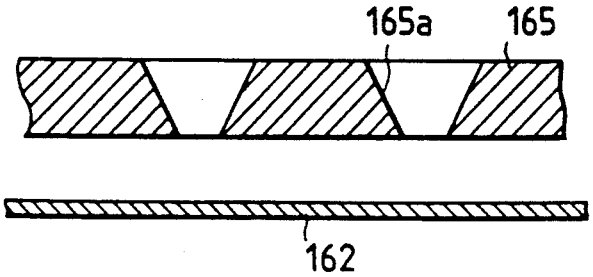
FIG. 16 is an illustrative diagram of the arrangement of the pattern plate when the pattern plate of FIG. 15(B) is used.

If the slits are formed through etching, the sides of slits are not parallel in the direction of thickness, being different from that shown in FIG. 15(A), The sides of slits may have a trapezoidal cross section as shown in FIG. 15(B), or a wedged cross section as shown in FIG. 15(C). In this case, the trapezoid is more desirable than the wedge. For a trapezoidal cross section, as shown in FIG. 16, it is preferable to mount the pattern plate such that the other side of resist-applied surface, i.e., a side of narrower aperture width faces the photorecepter 162.

Figure 17:
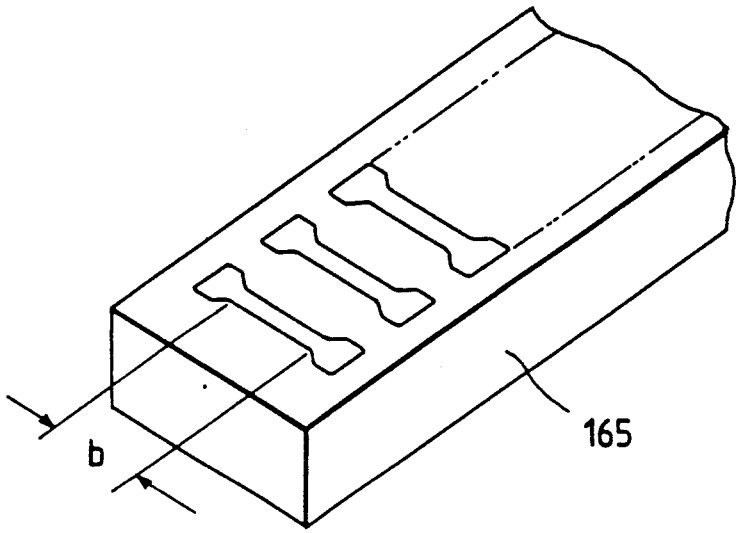
FIG. 17 is a perspective view illustrating the shape of slits when the pattern plate is made through etching process.
Figure 18:
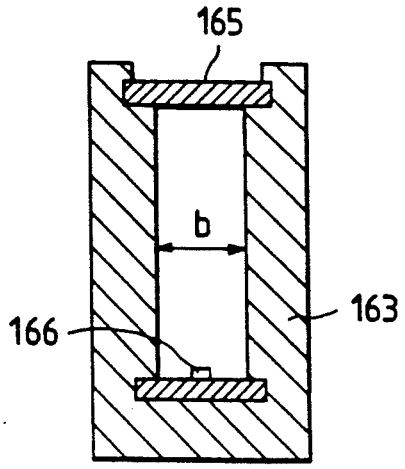
FIG. 18 is a cross-sectional view showing the construction in which the longitudinal dimension of the slits in the pattern plate is restricted.

Forming the slits through the etching process results in wider slits at the longitudinal ends thereof as shown in FIG. 17. In this case, as shown in FIG. 18, the longitudinal distance of a slit is restricted by side walls or edges of the opening side of the case 163 of the pattern exposing device, so that the light through the usable area of the slit(depicted by "b" in FIGS. 17 and 18) is exposed to the photorecepter. Additionally, by this arrangement, the length of bright-dark pattern in the direction of movement of the photorecepter may be adjusted.

The invention has been described with respect to embodiments based on the lithography and etching processes since the manufacture of pattern plate requires micromachining. However, the invention is not limited to these processes and other processes such as press and laser machining may also be used.

Although the ratio of slit width(Opening width) of the pattern plate to the pitch(closed width) of slits has been described as being one-to-one, the invention is not limited to the embodiment, and the ratio may be altered in accordance with the slit-like electrostatic latent image to be produced on the photorecepter.

In the above-described embodiment, the LED chips are used as infinitesimal light sources, and the type of LEDs may be selected from GaAsAl type, GaP type, and GaAsP type depending on the wavelength of light, output intensity, and surface potential of the photoreceptor to be discharged. Additionally, other infinitesimal light sources may be used in place of the LED chips.

The pattern exposing device case may be made of resin and metal. If resin is used, it should be black since insufficient thickness can transmit alight therethrough. A light opaque material may be applied to cover the outer wall of the case.

The use of metal as non light-transmissive material will reinforce mechanical strength. For example, aluminum is preferred for its heat sink characteristic and mechanical strength. The case is preferably black so that reflection and scattering of light is minimized for sharp bright-dark pattern. The pattern plate is also preferably black to prevent, for example, stray light. Thus, when the pattern is to be plated or painted, it is preferably black.

While a way of adjusting the width of the bright-dark pattern in the direction of the movement of photorecepter has been described with respect to the use of the wall of the case, the width may also be adjusted by properly selecting the shape of the slit that forms the pattern plate. In addition, a lens may be provided between the pattern plate and the infinitesimal light sources, though the construction is somewhat complex.

As is described previously, the greater the focal depth of the bright-dark pattern is, the greater the allowable errors in the various dimensions of the apparatus are. The depth may be increased by using the following construction in addition to the aforementioned construction.

Figure 19:
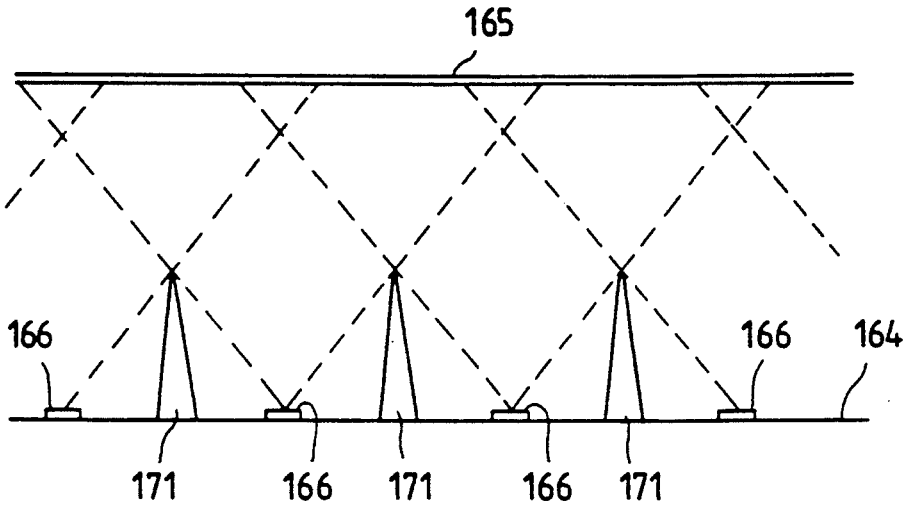
FIG. 19 is a diagram illustrating the arrangement of partitions.
Figure 20:
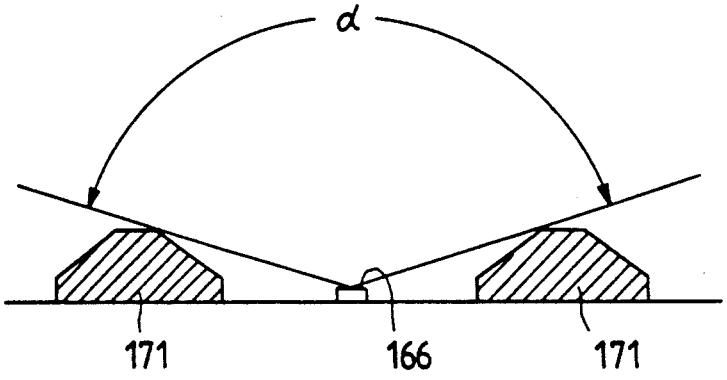
FIG. 20 is a cross-sectional view showing an example of the partitions.
Figure 21:
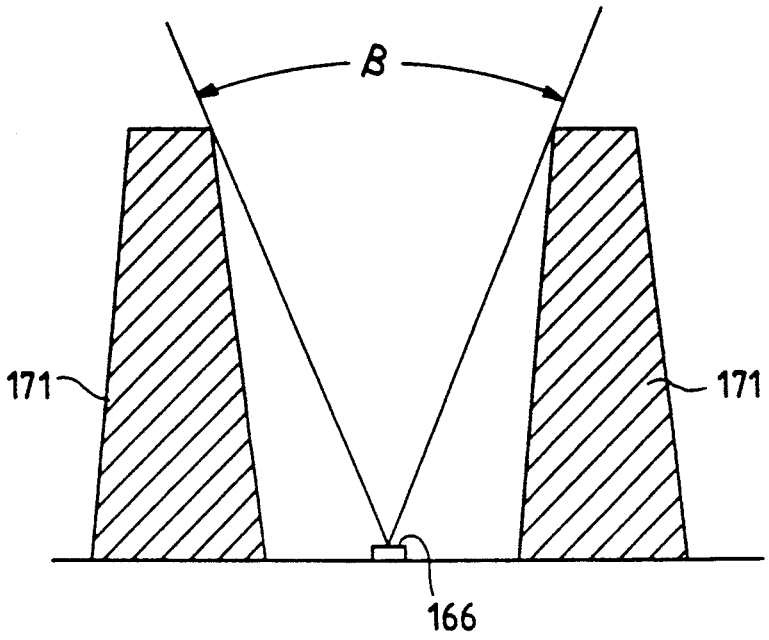
FIG. 21 is a cross-sectional view of another example of the partitions.
Figure 22:
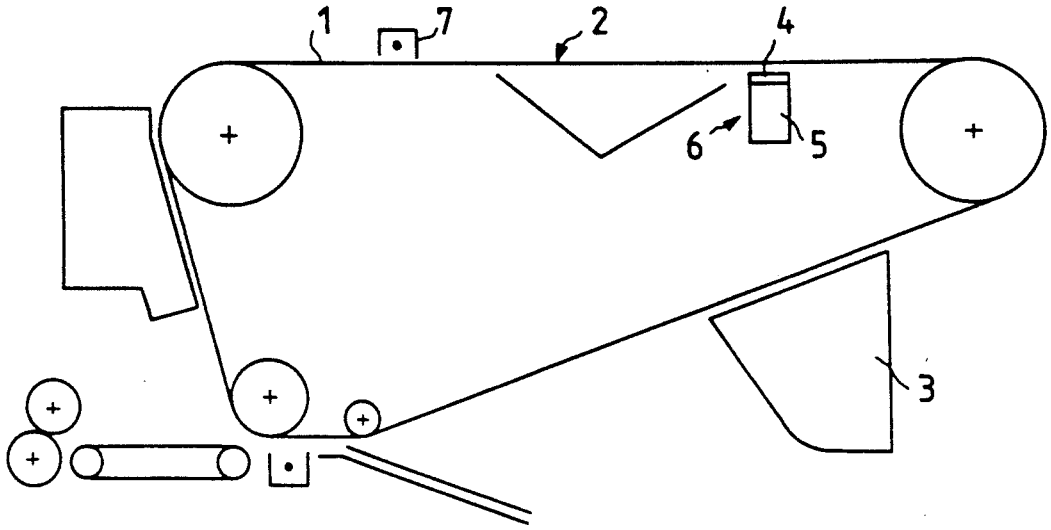
FIG. 22 illustrates a prior art apparatus.

That is, partitions 171 are provided between each and the next infinitesimal light sources 166 as shown in FIG. 19. When focusing our attention on part of the pattern plate 165, the focal depth of the bright-dark pattern is small if most of the light passes through part of a slit at large angles relative to the pattern plate 165, i.e., if most of the light passing through that part of the slit are from relatively remote light sources. Thus, the focal depth can be made greater by partitioning the infinitesimal light sources 166, which contribute to the focal depth, with the partition 171 so as to control the direction of light emission. The partitions 171 can be of the construction shown in FIGS. 20 and 21. The greater the height of partitions 171 is, the greater the focal depth is. However, the amount of light will decrease because a lesser number of infinitesimal light sources 166 contribute. Thus, the height of partitions should be determined on the basis of the desired depth, pitches between the infinitesimal light sources 166, and amount of light.

As mentioned above, according to the present invention, the distance between the pattern plate and the infinitesimal light sources is, for example, 30 mm, which makes the apparatus smaller in size than the prior art apparatus. The use of LED chips as infinitesimal light sources requires only a small amount of power, being economical. The quick response of LEDs to on-and-off operation not only eliminates a conventional shutter but also requires no expensive coupling lens. This leads to simple and inexpensive construction.

If the photorecepter is light transmissive, the pattern exposing device may be arranged behind the photorecepter. The pattern exposing device may be located anywhere between the charged corotron and the developer, such as in front of or behind a position where the image of original is exposed.

Being constructed as mentioned above, the present invention ensures small size, simple construction, and low cost of a pattern exposing device.

What is claimed is:

1. An image producing apparatus comprising:

a uniformly charged movable photosensitive material, said photosensitive material having a surface for forming an electrostatic latent image of an original image in response to exposure to light;

pattern exposing means for exposing said photosensitive material to light to form said electrostatic latent image on said surface, said electrostatic latent image being in the form of a plurality of slits spaced apart by a predetermined distance, wherein said pattern exposing means includes:

a plurality of infinitesimal light sources aligned at equal pitches substantially transversely to the direction of movement of said photosensitive material, a pattern plate positioned between said plurality of infinitesimal light sources and said surface of said photosensitive material, said pattern plate having a plurality of light transmitting areas and a plurality of light opaque areas, each of said transmitting areas being disposed adjacent one of said opaque areas;

means for developing said electrostatic image formed on said surface of said photosensitive material with a toner; and means for transferring the developed toner image to a transfer material.

2. An image producing apparatus according to claim 1, wherein said plurality of infinitesimal light sources are aligned in a row with a predetermined distance between adjacent light sources to produce a plurality of bright-dark patterns between said pattern plate and said photosensitive material, said patterns being aligned such that bright areas are positioned alternately with dark areas corresponding to the alignment of said row of infinitesimal light sources, said light sources being further aligned such that the photosensitive material is exposed to at least one of the plurality of bright-dark patterns.

3. An image producing apparatus according to claim 1, wherein said plurality of infinitesimal light sources are housed in a chassis, said chassis having an opening and being optically shielded except for said opening, and said chassis having an inner wall of a color of low reflectivity.

4. An image producing apparatus according to claim 3, wherein said pattern plate is an opaque plate having a plurality of slits for providing said bright and dark areas.

5. An image producing apparatus according to claim 4, wherein said chassis includes at least two sidewalls, said pattern plate being disposed between said sidewalls such that longitudinal portions of said slits extend perpendicular to said sidewalls, and the length of said longitudinal portions is restricted by abutment with said sidewalls.

6. An image producing apparatus according to claim 1, wherein said pattern plate is an opaque plate having a plurality of slits for providing said bright and dark areas.

7. An image producing apparatus according to claim 1, wherein said plurality of infinitesimal light sources are light emitting diode chips.

8. An image producing apparatus according to claim 7, wherein each of said light emitting diode chips is spaced approximately 4 millimeters from adjacent chips.

9. An image producing apparatus according to claim 3, wherein each of said infinitesimal light sources are separated from adjacent light sources by a respective partition, each of the partitions having a height selected to control the emission of light from each of said light sources to a desired angle.

10. A lamp-mounting construction for an image producing apparatus, comprising:

a plurality of rollers mounted on a frame;

a continuous belt type photoreceptor rotatably mounted about said plurality of rollers;

a charger, an exposing device, a developer, and a transfer device disposed in order around said belt type photoreceptor in a direction of movement of said belt type photoreceptor and disposed adjacent to a surface of said belt type photoreceptor; and a lamp disposed adjacent to at least one of said plurality of rollers such that a predetermined distance is substantially maintained between the lamp and the surface of the belt type photoreceptor, said lamp being disposed adjacent said surface of said belt type photoreceptor at a position intermediate at said charger and said developer.

11. A lamp-mounting construction according to claim 10, wherein said lamp is disposed between two of said plurality of rollers.

12. A lamp-mounting construction for an image producing apparatus, comprising:

a photoreceptor supporting frame having a front vertical plate and a rear vertical plate, said front and rear vertical plates being connected;

a plurality of rollers mounted on said frame;

a continuous belt type photoreceptor rotatably mounted about said plurality of rollers;

a charger, an exposing device, a developer, and a transfer device disposed in order around said belt type photoreceptor in a direction of movement of said belt type photoreceptor and disposed adjacent to a surface of said belt type photoreceptor, wherein at least two of said plurality of rollers are mounted on said frame a short distance apart, the at least two rollers are disposed at a position intermediate of said charger and said developer; and a lamp disposed adjacent to the at least two rollers such that a predetermined distance is substantially maintained between the lamp and the surface of the belt type photoreceptor.

13. A lamp-mounting construction according to claim 12, wherein said lamp is disposed between the at least two rollers.

* * * * *

UNITED STATES PATENT AND TRADEMARK OFFICE

CERTIFICATE OF CORRECTION

PATENT NO. : 5,289,235

DATED : February 22, 1994

INVENTOR(S) : Makoto Sakanobe et al.

It is certified that error appears in the above-indentified patent and that said Letters Patent is hereby corrected as shown below:

Abstract, front page, line 4, change "are" to --there is--.

Claim 10, column 14, line 34, change "at" (second occurrence) to --of--.

Signed and Sealed this

Thirteenth Day of September, 1994

*Attest:*

Bruce Lehman

BRUCE LEHMAN

*Attesting Officer*

*Commissioner of Patents and Trademarks*